US011549226B1

(12) United States Patent
Jones

(10) Patent No.: US 11,549,226 B1
(45) Date of Patent: Jan. 10, 2023

(54) SNOW DIVERTER MECHANISM

(71) Applicant: Charles M. Jones, Woodridge, IL (US)

(72) Inventor: Charles M. Jones, Woodridge, IL (US)

( * ) Notice: Subject to any disclaimer, the term of this patent is extended or adjusted under 35 U.S.C. 154(b) by 0 days.

(21) Appl. No.: 17/693,320

(22) Filed: Mar. 12, 2022

(51) Int. Cl.
*E01H 5/06* (2006.01)

(52) U.S. Cl.
CPC ..... *E01H 5/066* (2013.01); *E01H 5/061* (2013.01)

(58) Field of Classification Search
CPC ..... E01H 4/02
See application file for complete search history.

(56) References Cited

U.S. PATENT DOCUMENTS 3,055,126 A * 9/1962 Emhof ..... E01H 5/065 37/280
3,407,519 A * 10/1968 Batko ..... E01H 5/065 37/280
4,077,139 A * 3/1978 Fagervold ..... E01H 5/067 37/280
4,372,617 A * 2/1983 Zamboni ..... E01H 4/023 299/24
4,614,048 A * 9/1986 Melby ..... E01H 5/065 37/280
5,758,728 A * 6/1998 Ragule ..... E01H 5/065 172/815
5,819,444 A * 10/1998 Desmarais ..... E01H 5/065 37/234
5,860,230 A * 1/1999 Daniels ..... E01H 5/06 37/231
5,903,986 A * 5/1999 Parker ..... E01H 5/066 172/815
6,249,992 B1 6/2001 Irving
6,363,631 B1 * 4/2002 Cordingley ..... E01H 5/066 37/280
6,681,505 B1 1/2004 Wells
7,100,311 B2 * 9/2006 Verseef ..... E01H 5/066 37/234
7,481,011 B2 1/2009 Nesseth
7,493,710 B2 2/2009 Frey et al.
7,681,337 B2 * 3/2010 Watson ..... E01H 5/065 37/274
7,730,644 B2 6/2010 Frey
8,051,587 B2 11/2011 Mills
10,113,283 B1 * 10/2018 Jones ..... E01H 5/066
10,612,202 B1 * 4/2020 Jones ..... E01H 5/066
2005/0246926 A1 11/2005 Verseef

* cited by examiner

*Primary Examiner* — Jessica H Lutz

(57) ABSTRACT

A snow diverter mechanism for deflecting snow being thrown by a snow plow, away from such objects as driveways, fire hydrants and mail boxes. The snow diverter is positioned inside the concave curve of and a predefined distance from the curved side edge of the snow plow blade to avoid snagging the snow diverter mechanism on a curb or other obstacles.

11 Claims, 17 Drawing Sheets

SNOW DIVERTER MECHANISM

TECHNICAL FIELD OF THE INVENTION

This invention relates generally to the avoidance of the throwing of plowed snow on objects such as driveways, mail boxes and fire hydrants when plowing snow on roadways. More specifically, this invention relates to a snow diverter mounted on the inside curve of a snow plow blade that can never snag on a curb of other obstruction to avoid the throwing of plowed snow on objects such as driveways, mail boxes and fire hydrants when plowing snow on roadways.

BACKGROUND OF THE INVENTION— PRIOR ART

A long standing problem in snowy areas reoccurs when a snow plow throws plowed snow objects such as the end of driveways, in front of mailboxes and on top of fire hydrants. Most attempts to solve this problem involve a snow diverter of various designs attached to the edge of a snow plow blade. One problem with most of these designs is that if any portion of the diverter protrudes from the locus of the moving snow plow blade, it may snag on a curb or other obstruction. For example see patents U.S. Pat. Nos. 6,249,992, 6,681,505, 7,481,011, 7,681,337, 7,730,644, 7,493,710, 7,100,311 or US patent application 2005-0246926. Some other designs involve a diverter paddle that swings down to divert the plowed snow. While this design should not snag (unless mounted on the side of the blade), the cantilevered paddle in the up position like a flag pole will cause problematic vibration forces on the structure (see U.S. Pat. No. 8,051,587). Some of these designs also require a complex mechanism that increases the risk of mechanical problems. Plowing strategies that eliminate a snow diverter and attempt to manually change the plow blade angle for every object encountered require increased skills and attention resulting in added time and cost to the plowing process.

SUMMARY OF THE INVENTION

The present invention solves the above mentioned long standing problem with a snag-free snow diverter mechanism. It accomplishes this by mounting a diverter within the inside curve of the snow plow blade a short distance from the edge of the blade to prevent snagging on a curb or on another obstacle. The design of the diverter plate minimizes the resistance to the flow of plowed snow as it is discharged off the side of the blade. The snow diverter mechanism may be operated in a manual mode or in an automatic mode. In a manual mode the driver simply hits a "Divert button" at the start of every object to avoid and then the "Cancel button" at the end of every object to resume discharging snow over the curb.

Although the snagging problem is solved with the manual mode it would still be somewhat labor intensive. This problem can be solved by using the present invention with an automatic object detection system (see U.S. Ser. No. 10/612,202) which uses GPS to initially (one-time) record the longitude and latitude of the start and end of objects such as driveways, fire hydrants and mailboxes. A GPS receiver in the snow plow vehicle then compares the current vehicle location to the recorded start and end of these objects and then automatically changes to the diverting mode when no objects are present. The drivers' attention is not required. This is the preferred method of operation.

The construction of the present invention is also very simple, essentially one moving part and a power actuator device. Therefore the risk of mechanical problems of a more complex mechanism is also minimized. The mechanical components of the snow diverter mechanism are as follows:

A snow diverter mechanism is pivotally mounted inside the curve of the snow plow blade a predetermined distance "D1" from the side edge of the blade so that the snow diverter mechanism is approximately parallel, in the diverting mode, to the direction of travel of the snow plow vehicle, and therefore cannot snag on a curb (i.e. protected by the snow plow blade). This is true regardless of the angle of attack the blade is positioned in. Then in the non-diverting mode, the snow diverter mechanism is approximately parallel to the flow of snow along the snow plow blade which minimizes the resistance to the flow of snow which is being discharged. A power actuator device moves the snow diverter mechanism between the diverting and the non-diverting modes.

LEXICON

101 first embodiment of the snow diverter mechanism
102 second embodiment of the snow diverter mechanism
103 first embodiment of the snow diverter plate
104 second embodiment of the snow diverter plate
105 leading edge of the first embodiment of the snow diverter plate
107 trailing of the first embodiment of the snow diverter plate
110 taper on the first embodiment of the snow diverter plate
115 curb
120 snow plow blade
130 snow plow vehicle
150 an object to avoid throwing plowed snow on
160 pattern of non-diverted plowed snow
170 pattern of diverted plowed snow
180 Angle of attack (relative to a line perpendicular to the direction of travel) labeled as "B"
190 diverting angle relative to the blade labeled as "A"
200 first side Edge of Snow Plow Blade
210 second side Edge of Snow Plow Blade
300 a first predefined distance from the side edge of the snow plow blade labeled "D1"
400 direction of travel of the snow plow vehicle
410 power actuator device
500 controller
510 GPS receiver
600 snow diverter mechanism pivot axis
700 driver—the human or computer driving a snow plow vehicle
800A the flow (direction) of snow in the snow non-diverting mode
800B the flow (direction) of snow in the snow diverting mode
900 snow diverter mechanism
910 snow diverter plate positioning mechanism
911 First pivot point
912 Second pivot point
913 Third pivot point
914 Fourth pivot point
920 A-Frame
930 blade solenoid
940 first lever
950 second lever

DETAIL DESCRIPTION OF THE EMBODIMENTS

Figure 1A:
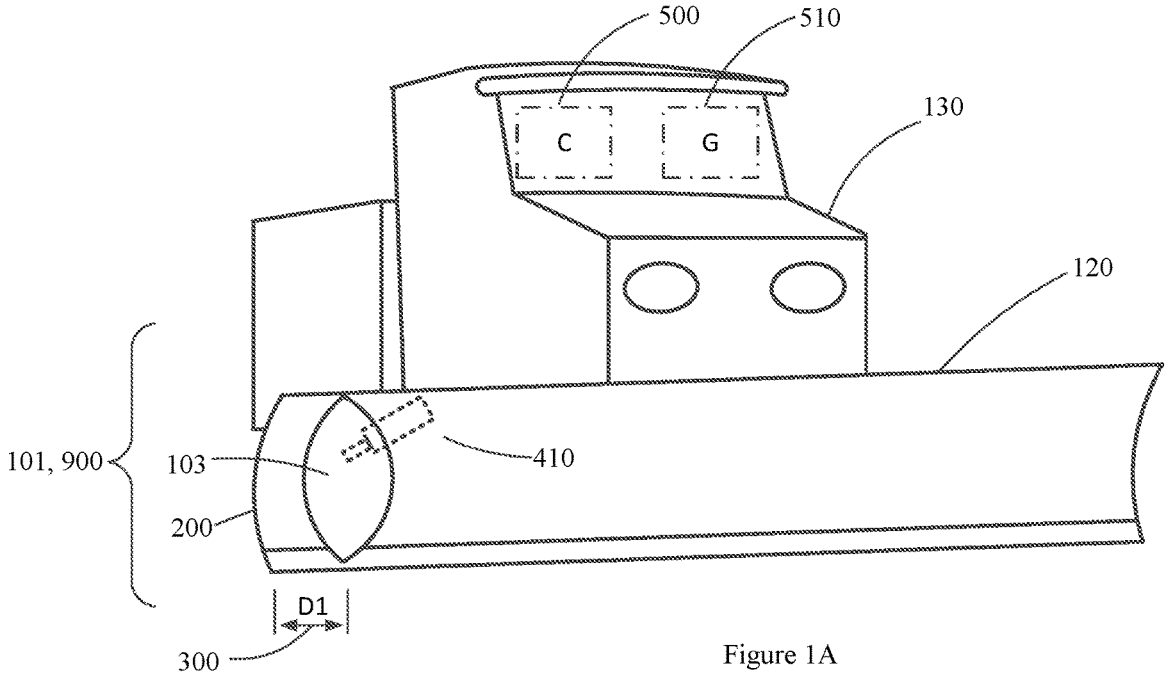
FIG. 1A is a perspective sketch of the first embodiment of the snow diverter mechanism in the non-diverting mode and positioned a predetermined distance "D1" from the first side edge 200 of the snow plow blade 120 to avoid snagging on a curb or other obstacles.

The detail description more fully describes two embodiments of the present invention with reference to the accompanying drawings. The two embodiments of the invention described are an oval shaped snow diverter plate that pivots within the concave curve of the plow blade and an approximately curved rectangular diverter plate that pivots out of the plow blade. Like numbers refer to like elements throughout. It is to be understood that these embodiments and claims are not limited in application to the details of construction and arrangement of the components set forth in the description and illustrated in the drawings. Rather, the description and the drawings provide examples of the embodiments envisioned, and the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

The present invention is a snow diverter mechanism 900 that is connected to a snow plow blade. Although it can be operated manually, it was intended to work in conjunction with an automatic driveway detection system (see U.S. Pat. No. 10,612,202).

Referring first to FIG. 1A, wherein is shown a perspective sketch of a snow plow vehicle 130 with a snow plow blade 120 attached to the vehicle with the first embodiment 101 of the snow diverter mechanism 900 positioned a predetermined distance "D1" 300 from the first side edge 200 of the snow plow blade 120. The controller 500 (shown with phantom lines and labeled with "C") and the GPS receiver 510 (shown with phantom lines and labeled with "G") are typically located in the cab of the snow plow vehicle. The diverter plate 103 is shown in the non-diverting mode parallel to the width of the plow blade. The diverter plate is made to change positions by the power actuator device 410.

Figure 1B:
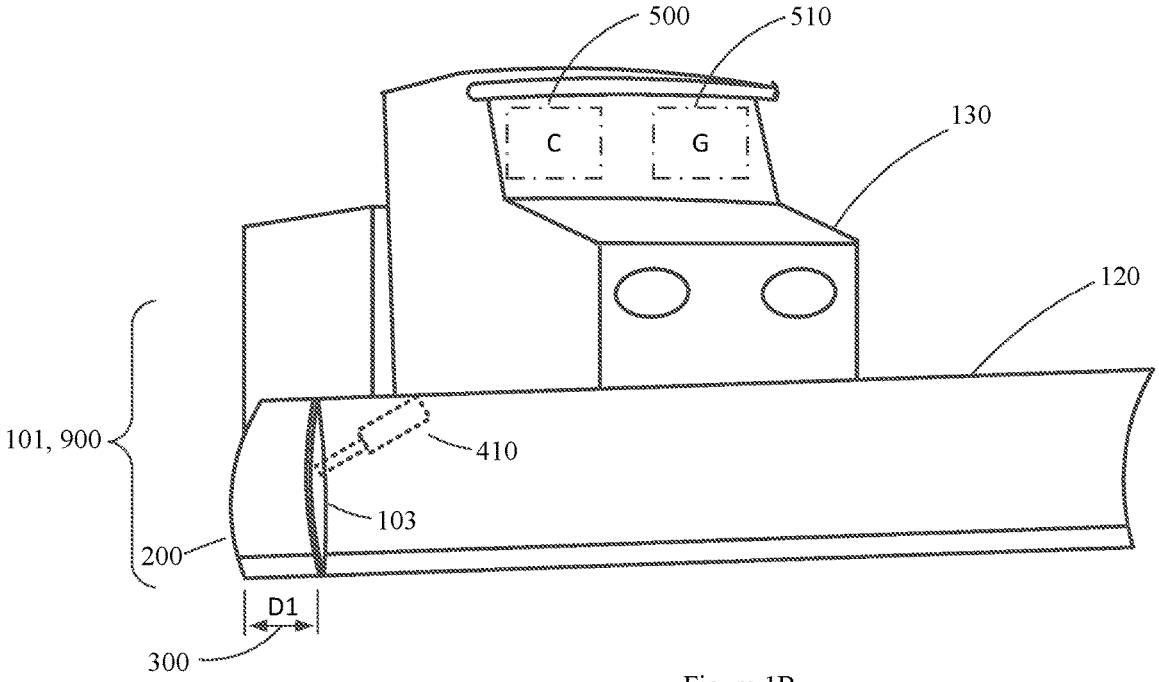
FIG. 1B is a perspective sketch of the first embodiment of the snow diverter mechanism in the diverting mode and positioned a predetermined distance "D1" from the first side edge 200 of the snow plow blade 120 to avoid snagging on a curb or other obstacles.

FIG. 1B is a perspective sketch of a snow plow vehicle 130 with a snow plow blade 120 attached to the vehicle with the first embodiment 101 of the snow diverter mechanism 900 positioned a predetermined distance "D1" 300 from the first side edge 200 of the snow plow blade 120. The controller 500 (shown with phantom lines and labeled with "C") and the GPS receiver 510 (shown with phantom lines and labeled with "G") are typically located in the cab of the snow plow vehicle. The diverter plate 103 is shown on the diverting mode approximately perpendicular to the width of the plow blade. The diverter plate is made to change positions by the power actuator device 410.

Figure 2A:
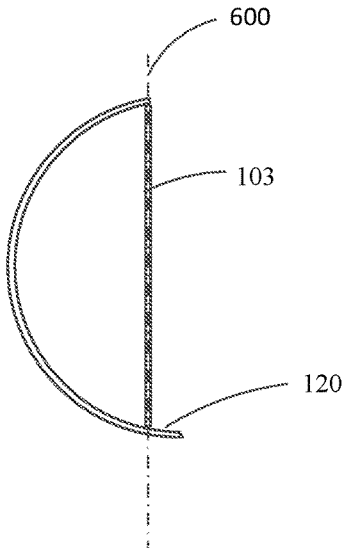
FIG. 2A is an edge view sketch of the plow blade with the first embodiment of the diverter plate on its pivot axis in the non-diverting position.

FIG. 2A is an edge view sketch of the plow blade 120 with the first embodiment of the diverter plate 103 on its pivot axis 600 in the non-diverting position.

Figure 2B:
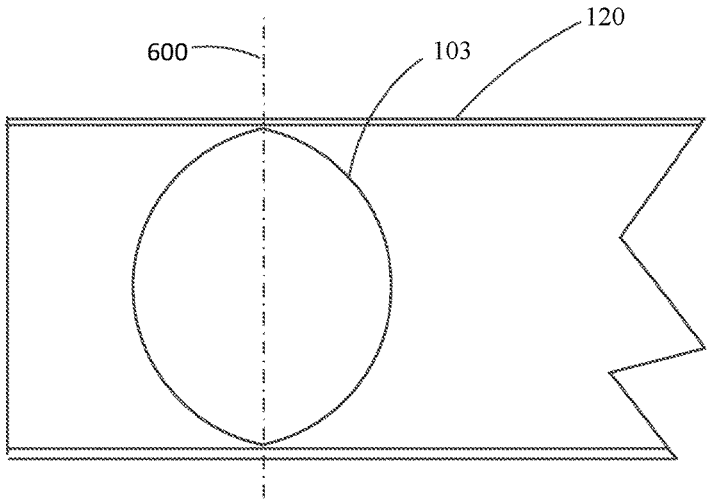
FIG. 2B is a front view sketch of the plow blade with the first embodiment of the diverter plate on its pivot axis in the non-diverting position.

FIG. 2B is a front view sketch of the plow blade 120 with the first embodiment of the diverter plate 103 on its pivot axis 600 in the non-diverting position.

Figure 2C:
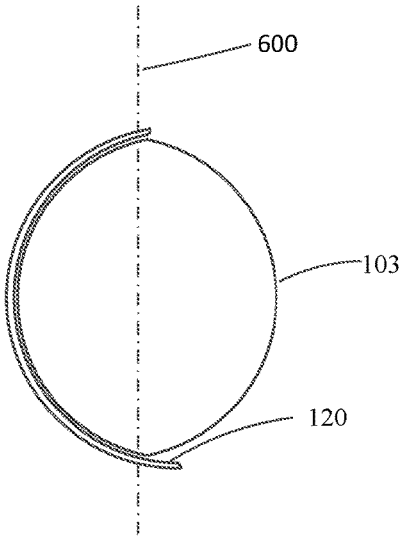
FIG. 2C is an edge view sketch of the plow blade with the first embodiment of the diverter plate on its pivot axis in the diverting position.

FIG. 2C is an edge view sketch of the plow blade 120 with the first embodiment of the diverter plate 103 on its pivot axis 600 in the diverting position.

Figure 2D:
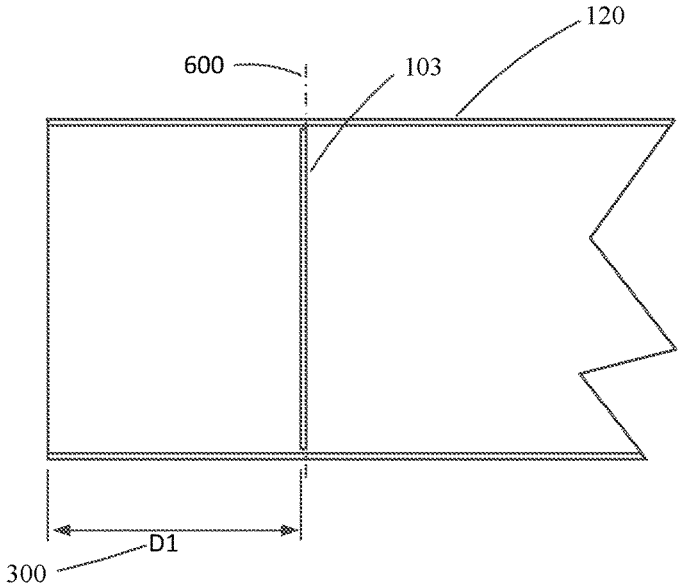
FIG. 2D is a front view sketch of the plow blade with the first embodiment of the diverter plate on its pivot axis in the diverting position.

FIG. 2D is a front view sketch of the plow blade 120 with the first embodiment of the diverter plate 103 on its pivot axis 600 in the diverting position.

Figure 3:
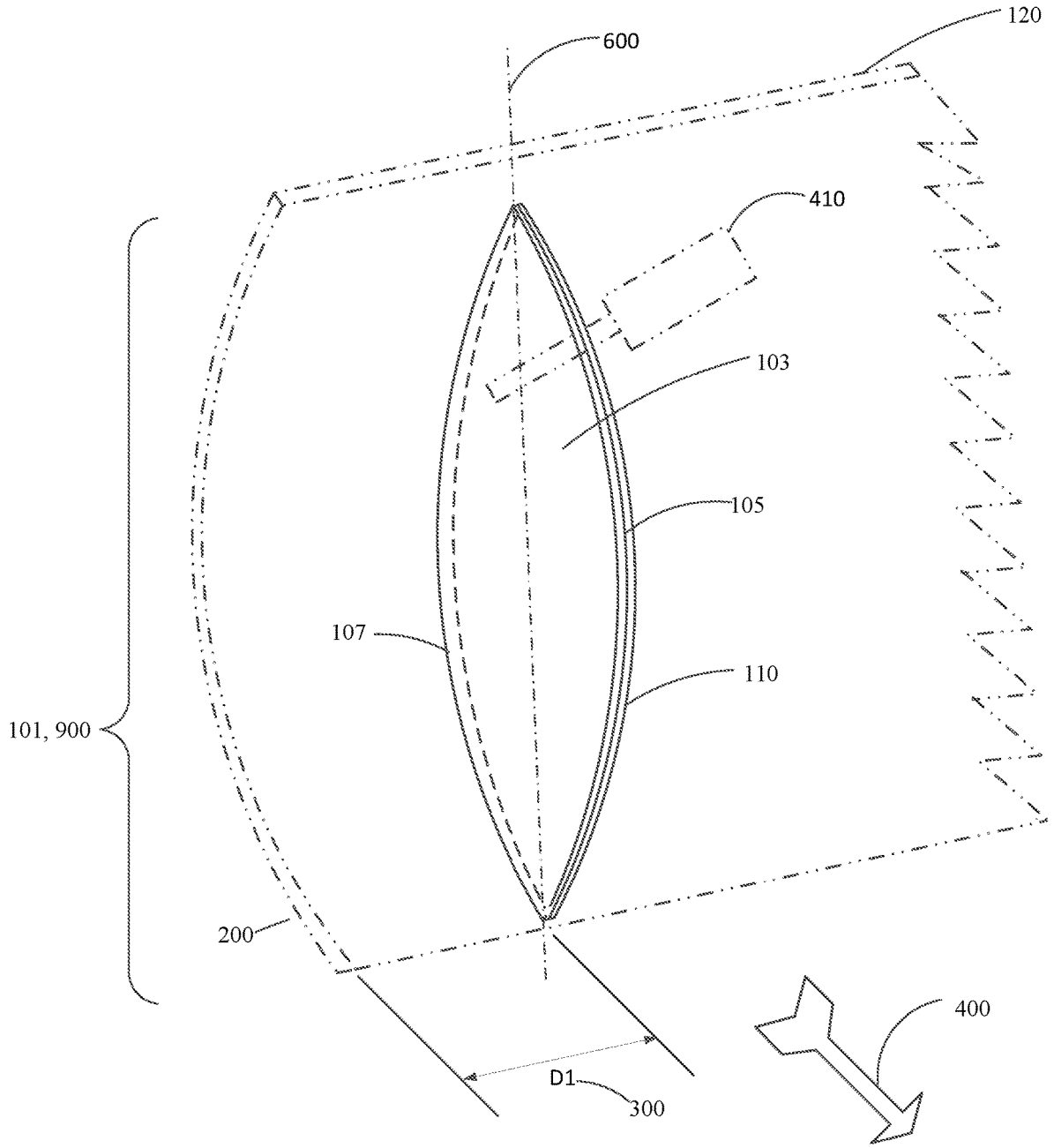
FIG. 3 is a perspective sketch of the first embodiment of the snow diverter mechanism in the diverting position.

FIG. 3 is a perspective sketch of the first embodiment 101 of the snow diverter mechanism 900 in the diverting position on its pivot axis 600 on the plow blade 120 (shown in phantom lines as a cut-a-way view) which is moving in a forward direction of travel 400. The diverter plate 103 has a tapered 110 leading edge 105 and a trailing edge 107. The diverter plate 103 is made to change positions by the power actuator device 410. The pivot axis 600 is located a predetermined distance "D1" 300 from the first side edge of the plow blade.

Figure 4A:
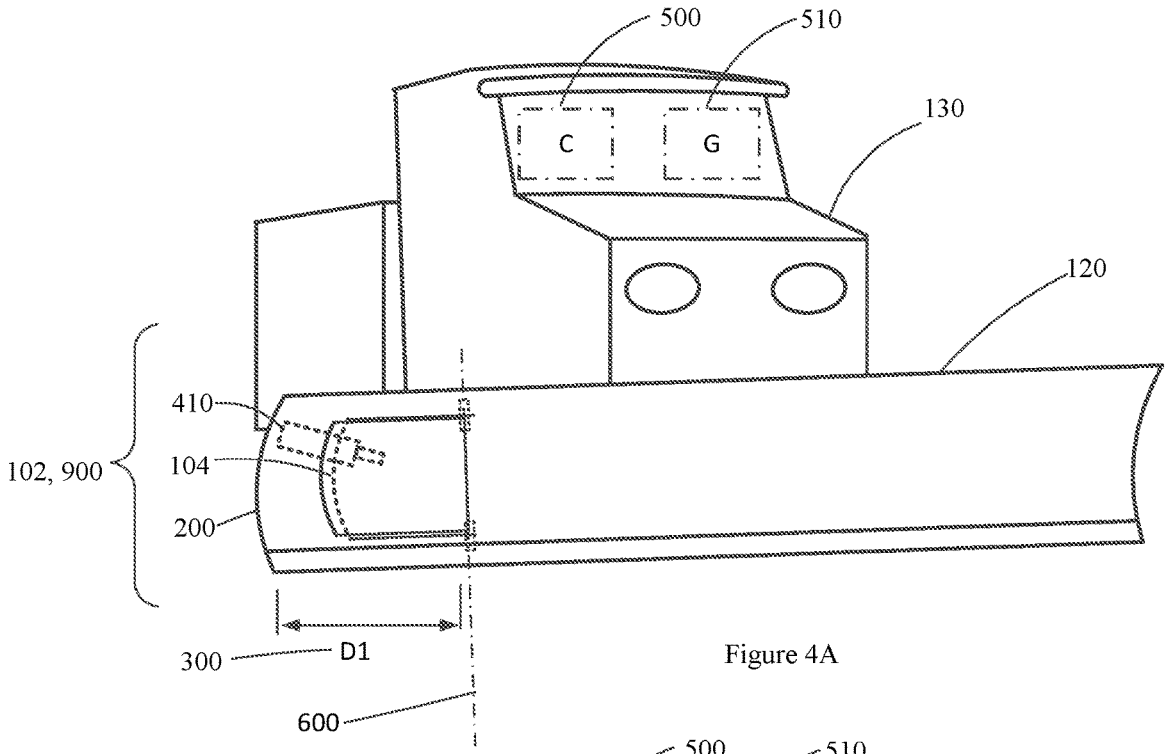
FIG. 4A, is a perspective sketch of the second embodiment of the snow diverter mechanism in the non-diverting mode.

FIG. 4A, wherein is shown a perspective sketch of a snow plow vehicle 130 with a snow plow blade 120 attached to the vehicle with the second embodiment 102 of the snow diverter mechanism 900 positioned a predetermined distance "D1" 300 from the first side edge 200 of the snow plow blade 120. The controller 500 (shown with phantom lines and labeled with "C") and the GPS receiver 510 (shown with phantom lines and labeled with "G") are typically located in the cab of the snow plow vehicle. The diverter plate 104, shown in the non-diverting mode, is made to change positions by the power actuator device 410.

Figure 4B:
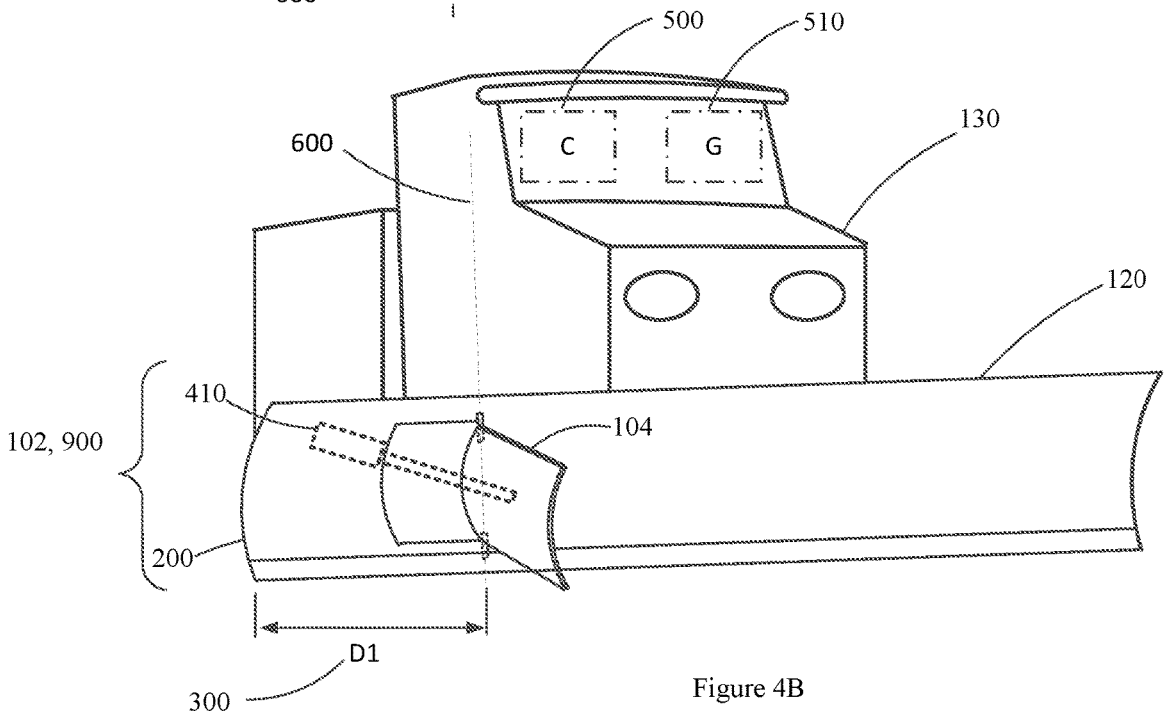
FIG. 4B, is a perspective sketch of the second embodiment of the snow diverter mechanism in the diverting mode.

FIG. 4B is a perspective sketch of a snow plow vehicle 130 with a snow plow blade 120 attached to the vehicle with the second embodiment 102 of the snow diverter mechanism 900 positioned a predetermined distance "D1" 300 from the first side edge 200 of the snow plow blade 120. The controller 500 (shown with phantom lines and labeled with "C") and the GPS receiver 510 (shown with phantom lines and labeled with "G") are typically located in the cab of the snow plow vehicle. The diverter plate 104, shown in the diverting mode, is made to change positions by the power actuator device 410.

Figure 5A:
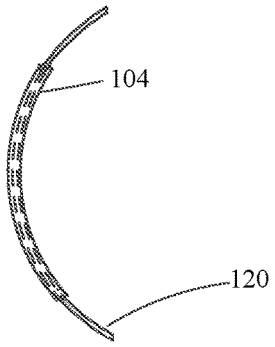
FIG. 5A is an edge view sketch of the plow blade with the second embodiment of the diverter plate on its pivot axis in the non-diverting position.

FIG. 5A is an edge view sketch of the plow blade 120 with the second embodiment of the diverter plate 104 in the non-diverting position.

Figure 5B:
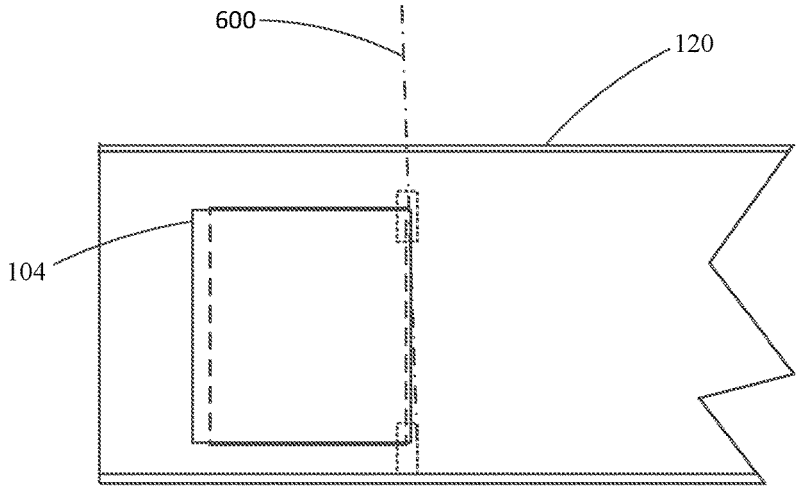
FIG. 5B is a front view sketch of the plow blade with the second embodiment of the diverter plate on its pivot axis in the non-diverting position.

FIG. 5B is a front view sketch of the plow blade 120 with the second embodiment of the diverter plate 104 on its pivot axis 600 in the non-diverting position.

Figure 5C:
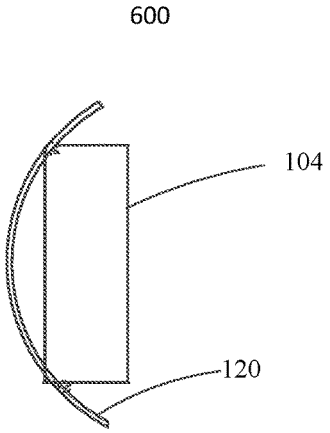
FIG. 5C is an edge view sketch of the plow blade with the second embodiment of the diverter plate on its pivot axis in the diverting position.

FIG. 5C is an edge view sketch of the plow blade 120 with the second embodiment 102 of the diverter plate 104 in the diverting position.

Figure 5D:
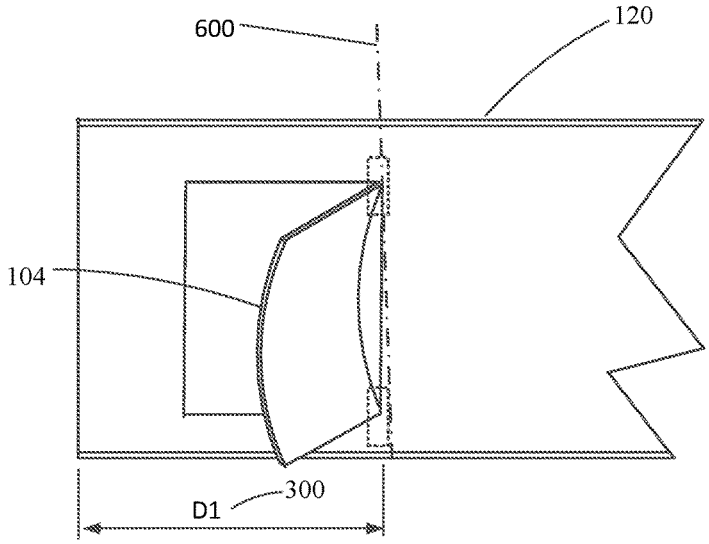
FIG. 5D is a front view sketch of the plow blade with the second embodiment of the diverter plate on its pivot axis in the diverting position.

FIG. 5D is a front view sketch of the plow blade 120 with the second embodiment 102 of the diverter plate 104 on its pivot axis 600 in the diverting position.

Figure 6:
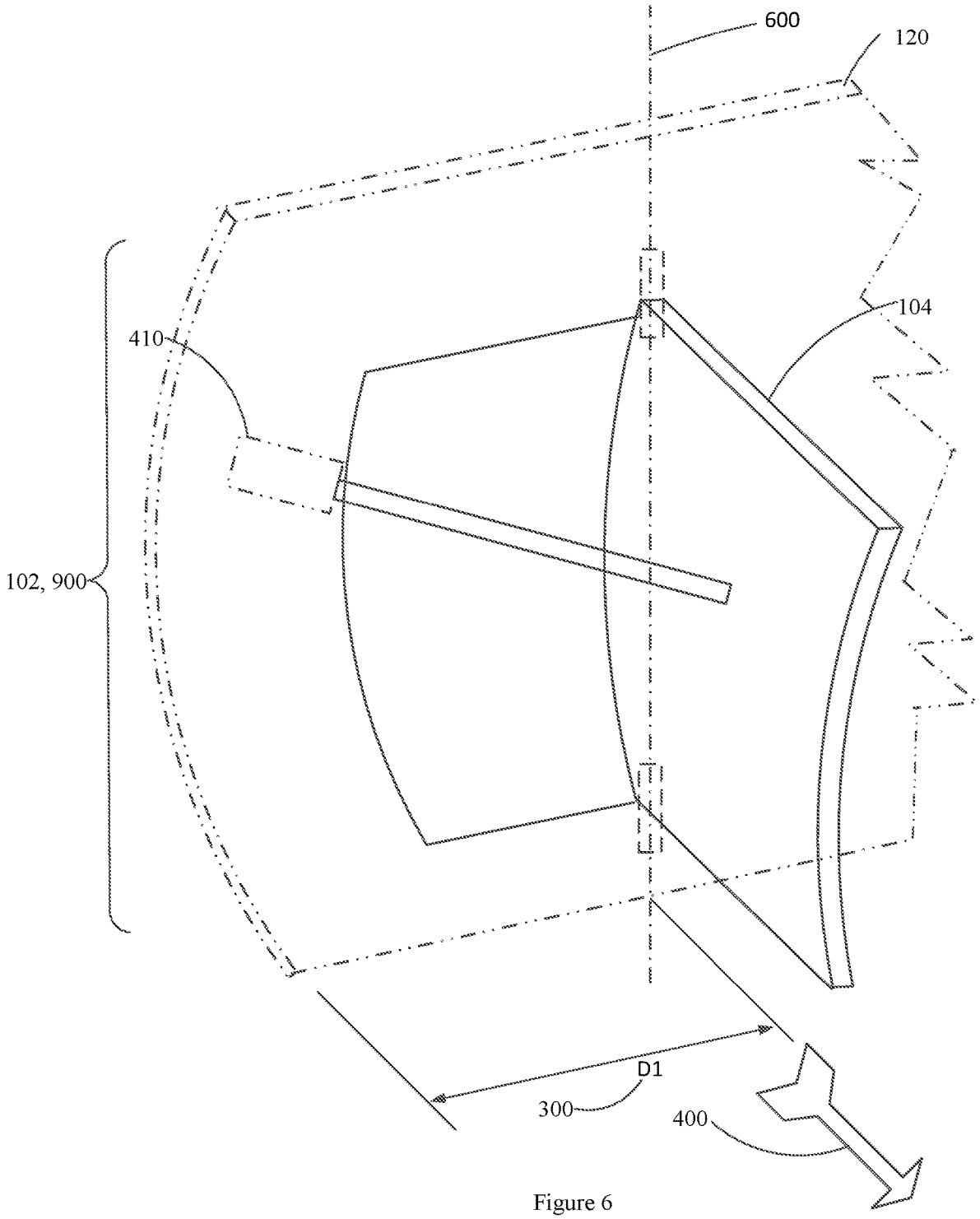
FIG. 6 is a perspective sketch of the second embodiment of the snow diverter mechanism in the diverting position.

FIG. 6 is a perspective sketch of the second embodiment 102 of the snow diverter mechanism 900 in the diverting position on its pivot axis 600 on the plow blade 120 (shown in phantom lines as a cut-a-way view) which is moving in a forward direction of travel 400. The diverter plate 104 is made to change positions by the power actuator device 410. The pivot axis 600 is located a predetermined distance "D1" 300 from the first side edge of the plow blade.

Figure 7C:
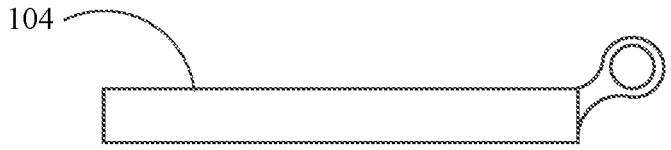
FIG. 7C is a second edge view sketch of the second embodiment of the snow diverter plate.
Figure 7A:
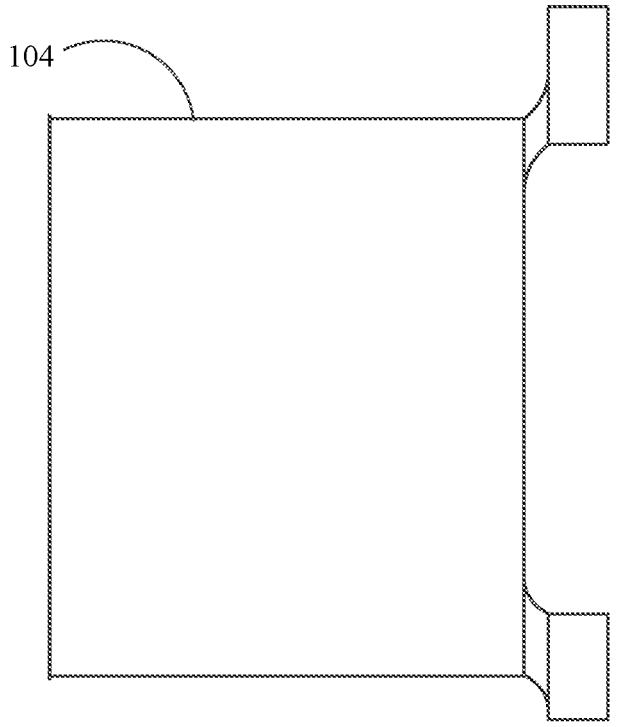
FIG. 7A is a front view sketch of the second embodiment of the snow diverter plate.

FIG. 7A is a front view sketch of the second embodiment of the snow diverter plate 104.

Figure 7B:
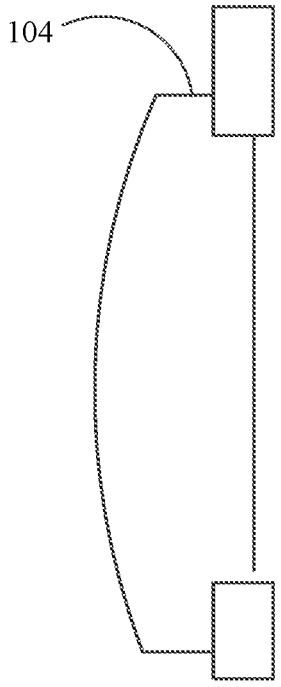
FIG. 7B is an edge view sketch of the second embodiment of the snow diverter plate.

FIG. 7B is an edge view sketch of the second embodiment of the snow diverter plate 104.

FIG. 7C is a second edge view sketch of the second embodiment of the snow diverter plate 104.

Figure 8A:
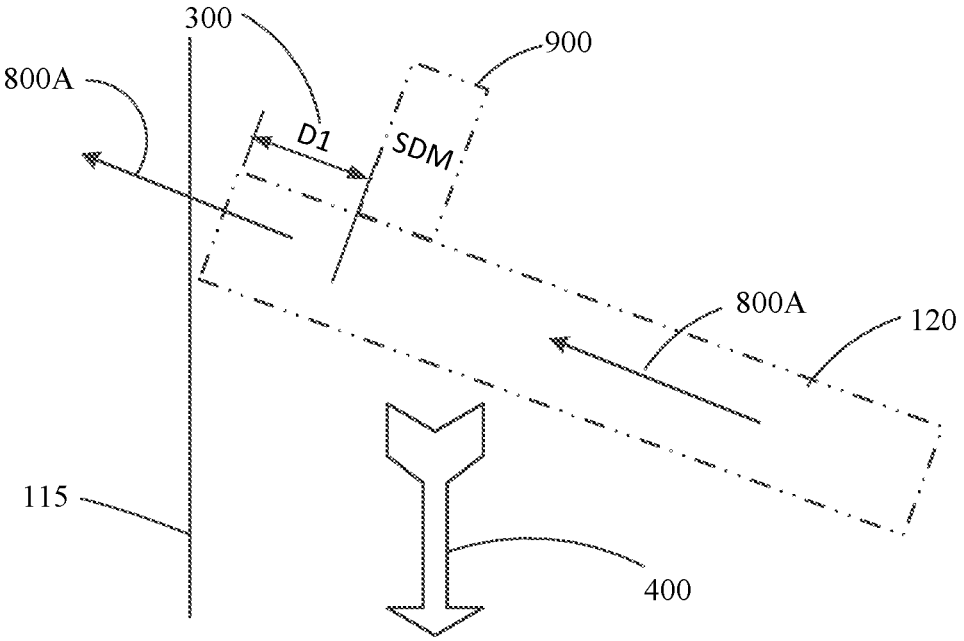
FIG. 8A is top view sketch of the snow diverter mechanism in the non-diverting mode showing the flow of snow along the snow plow blade.

FIG. 8A is top view sketch of the snow diverter mechanism 900 (shown in phantom lines and labeled with a "SDM") in the non-diverting mode with the snow plow blade 120 (shown in phantom lines) near a curb 115 with the snow diverter mechanism 900 positioned a predetermined distance "D1" 300 from a side edge of the snow plow blade approximately parallel to the flow of snow 800A along the snow plow blade 120 (shown with phantom lines). The predetermined distance "D1" is to insure that the snow diverter device will never snag of the curb or other obstacles as the plowed snow is thrown over the curb when the plow blade is moving in the displayed direction of travel 400.

Figure 8B:
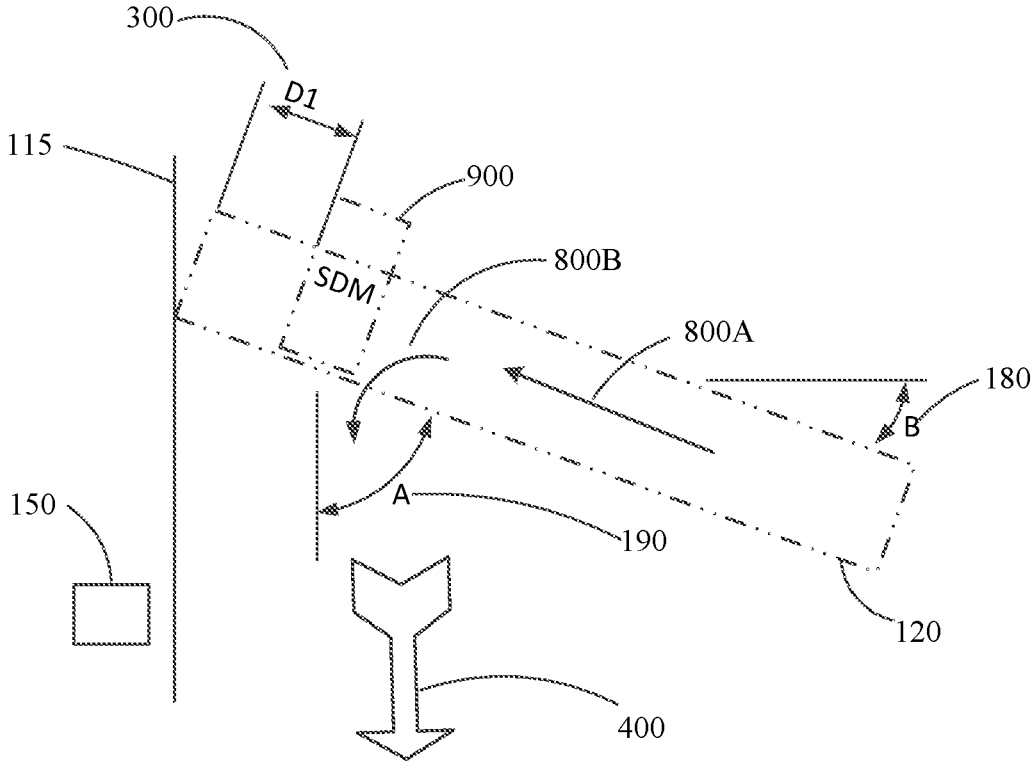
FIG. 8B is a top view sketch of the snow diverter mechanism in the diverting mode showing the flow of snow along and in front of the snow plow blade.

FIG. 8B is a top view sketch of the snow diverter mechanism 900 (shown in phantom lines and labeled with a "SDM") in the diverting mode with the snow plow blade 120 near a curb 115 with the snow diverter mechanism positioned a predetermined distance "D1" 300 from a side edge of the snow plow blade (shown with phantom lines) approximately parallel to the direction of travel 400 of the snow plow vehicle. When the snow plow blade is plowing at an angle of attack "B" 180, the diverter plate is positioned at an angle "A" 190 from the snow plow blade when in the diverting mode. The sum of "A" and "B" is always approximately 90 degrees in the diverting mode regardless of the angle of attack "A". The direction of travel 400 is shown as parallel to the curb 115. When the flow of plowed snow 800A along the snow plow blade meets the snow diverter mechanism 900 (in the diverting mode), it makes a turn 800B to be pushed past an object 150 to avoid.

Figure 9A:
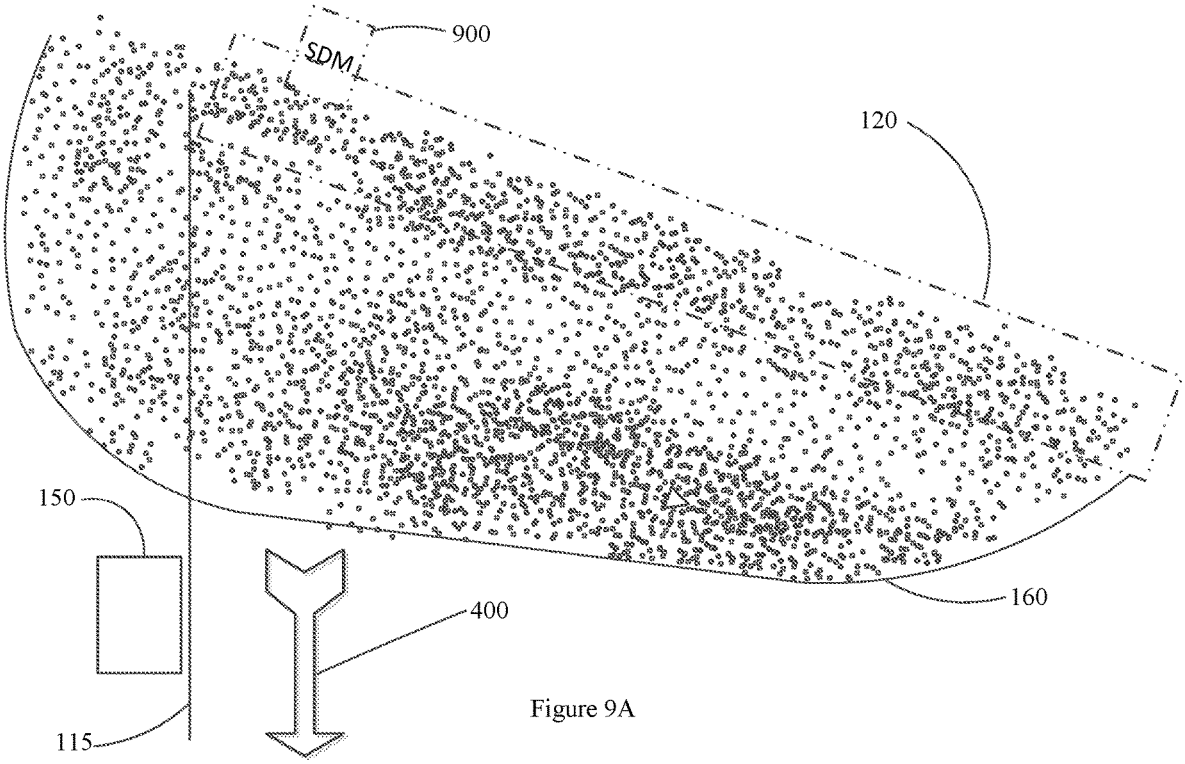
FIG. 9A is a top view sketch of the snow diverter mechanism in the non-diverting mode showing the pattern of non-diverted plowed snow thrown over the curb.

FIG. 9A is a top view sketch of the snow diverter mechanism 900 in the non-diverting mode showing the pattern 160 of non-diverted plowed snow thrown over the curb 115 by the snow plow blade 120 (shown in phantom lines) prior to encountering the object 150 to avoid when the snow plow vehicle is moving is the indicated direction of travel 400.

Figure 9B:
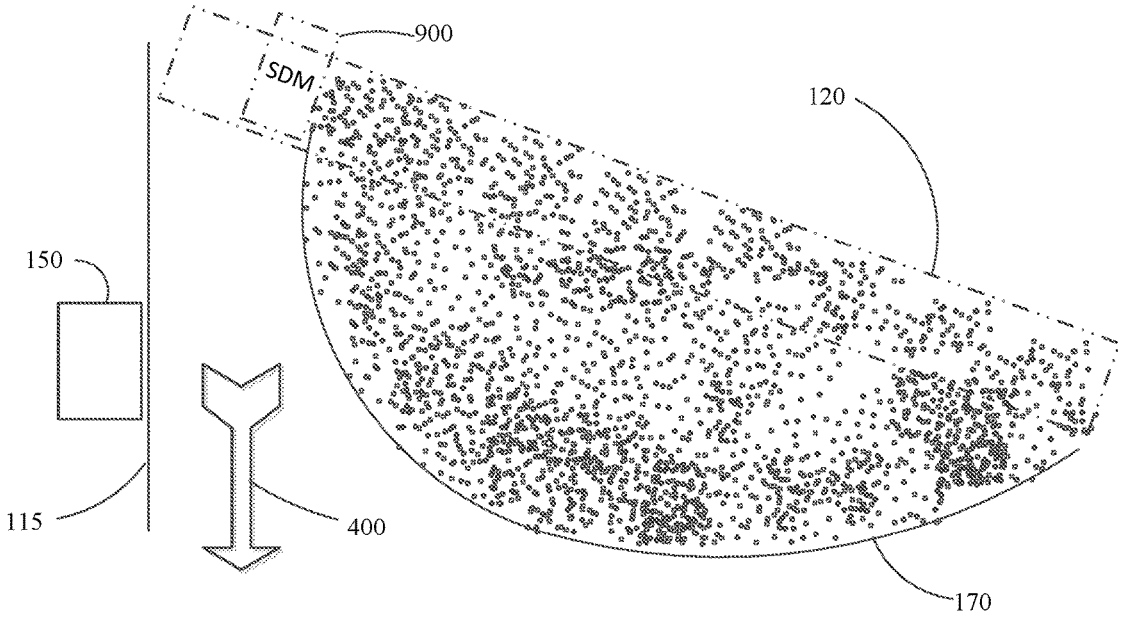
FIG. 9B is a top view sketch of the snow diverter mechanism in the diverting mode showing the pattern of diverted plowed snow pushed in front of the snow plow blade to avoid the object next to the curb.

FIG. 9B is a top view sketch of the snow diverter mechanism 900 in the diverting mode showing the pattern 170 of diverted plowed snow pushed in front of the snow plow blade 120 (shown in phantom lines) after encountering the object 150 to avoid next to the curb 115 when the snow plow vehicle is moving is the indicated direction of travel 400.

Figure 10:
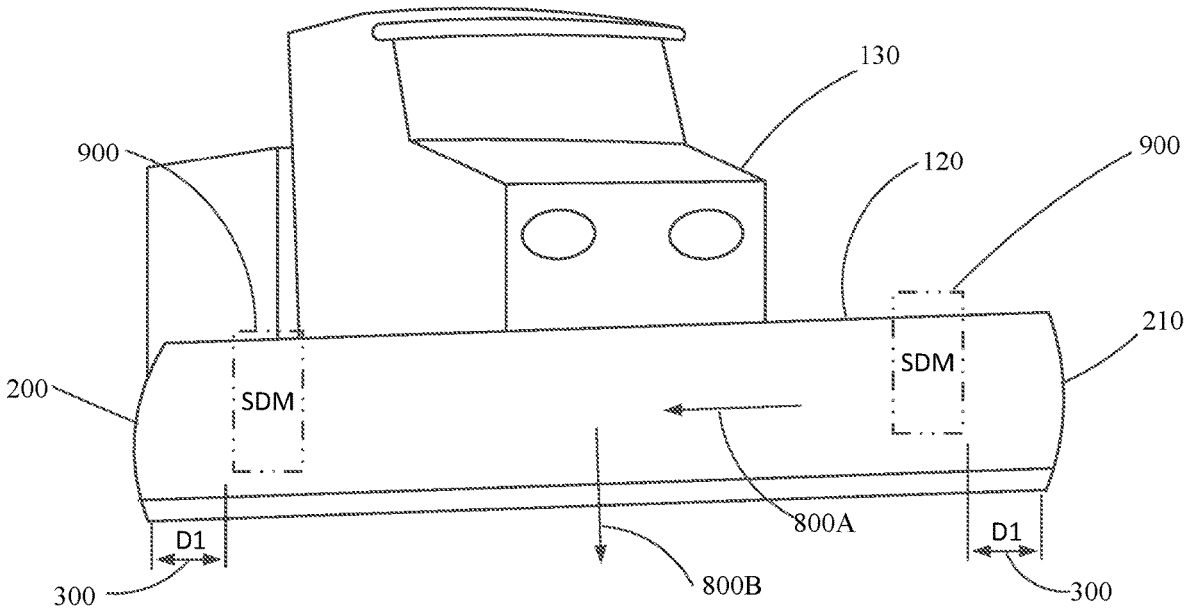
FIG. 10 is a perspective sketch of a snow plow vehicle 130 with two snow diverter mechanisms.

FIG. 10 is a perspective sketch of a snow plow vehicle 130 with two snow diverter mechanism(s) 900 (shown in phantom lines and labeled with a "SDM") in the non-diverting mode attached to the snow plow blade 120 in a position not to interfere with the flow of plowed snow 800A along the snow plow blade. Each snow diverter mechanism is positioned a predefined distance "D1" 300 from the side edges 200, 210 of the snow plow blade. If the snow diverter mechanism is in the non-diverting mode then the plowed snow will follow the flow line 800A off the side edge of the snow plow blade. If the snow diverter mechanism is in the diverting mode then the plowed snow will follow the flow line 800B and be pushed in front of the snow plow blade. The two snow diverter mechanisms 900 are able to operate independently from or together with each other as desired.

Figure 11:
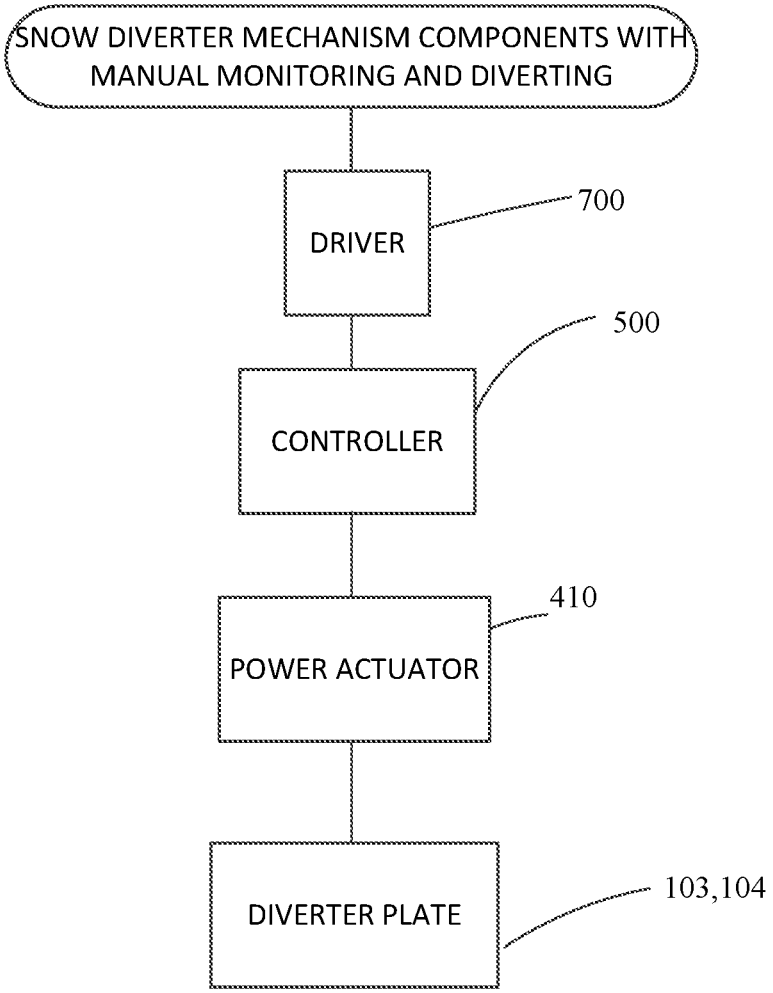
FIG. 11 is a diagram of the components of a manually driven snow plow vehicle with the snow diverter mechanism.

FIG. 11 is a diagram of the components (which include a driver 700) of a manual configuration of the snow diverter mechanism operated by the driver. The driver uses the controller 500 to activate and deactivate the power actuator device 410 to change the diverter plate 103,104 between the diverting and non-diverting positions.

Figure 12:
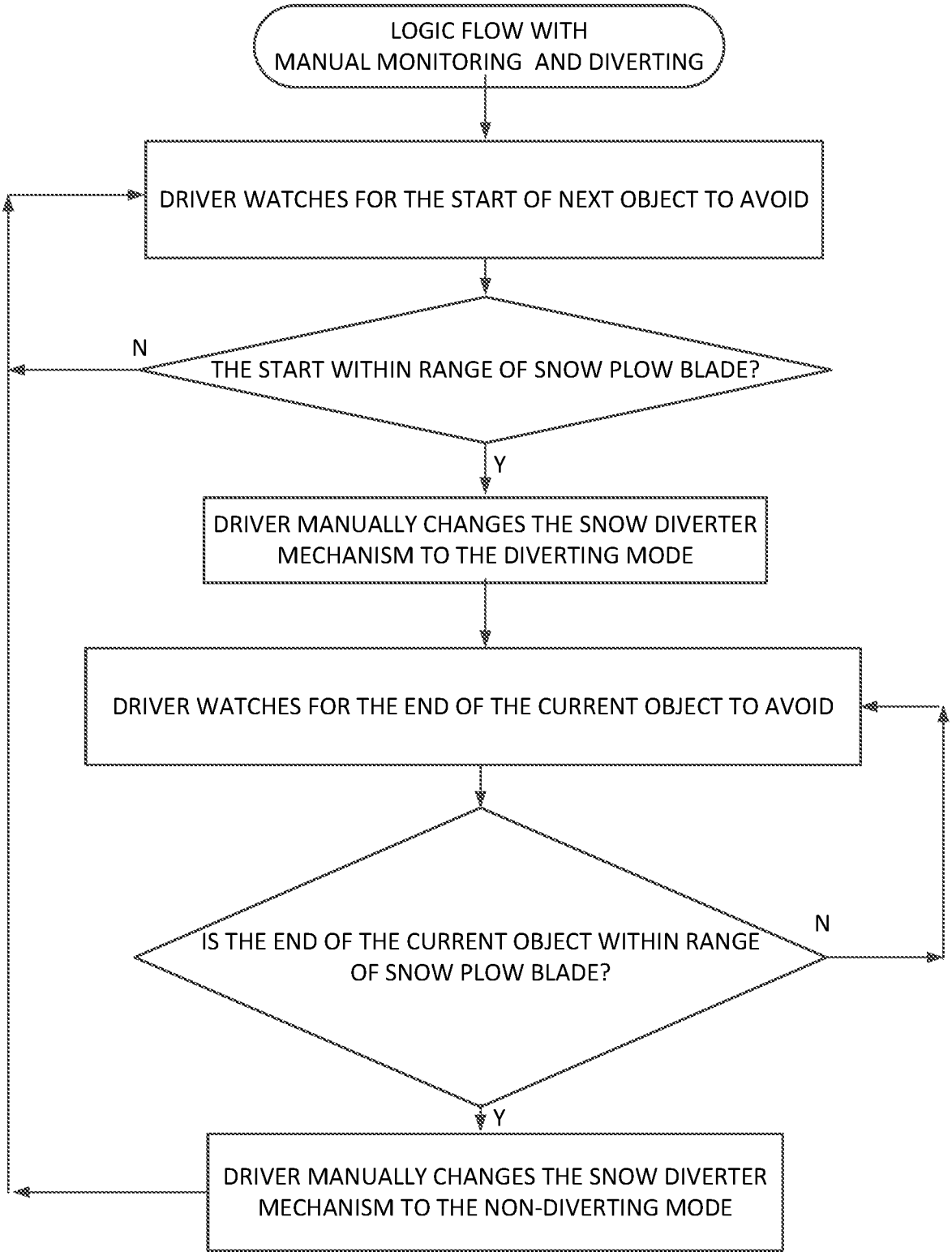
FIG. 12 is a flow chart of the manually controlled snow diverter mechanism.

FIG. 12 is a flow chart of the operation of the manual configuration of the snow diverter mechanism. The driver must watch for the start of every object to avoid. Then when the object is within range the driver activates the diverter device. Then the driver must then watch for the end of the object to change back to the non-diverting mode.

Figure 13:
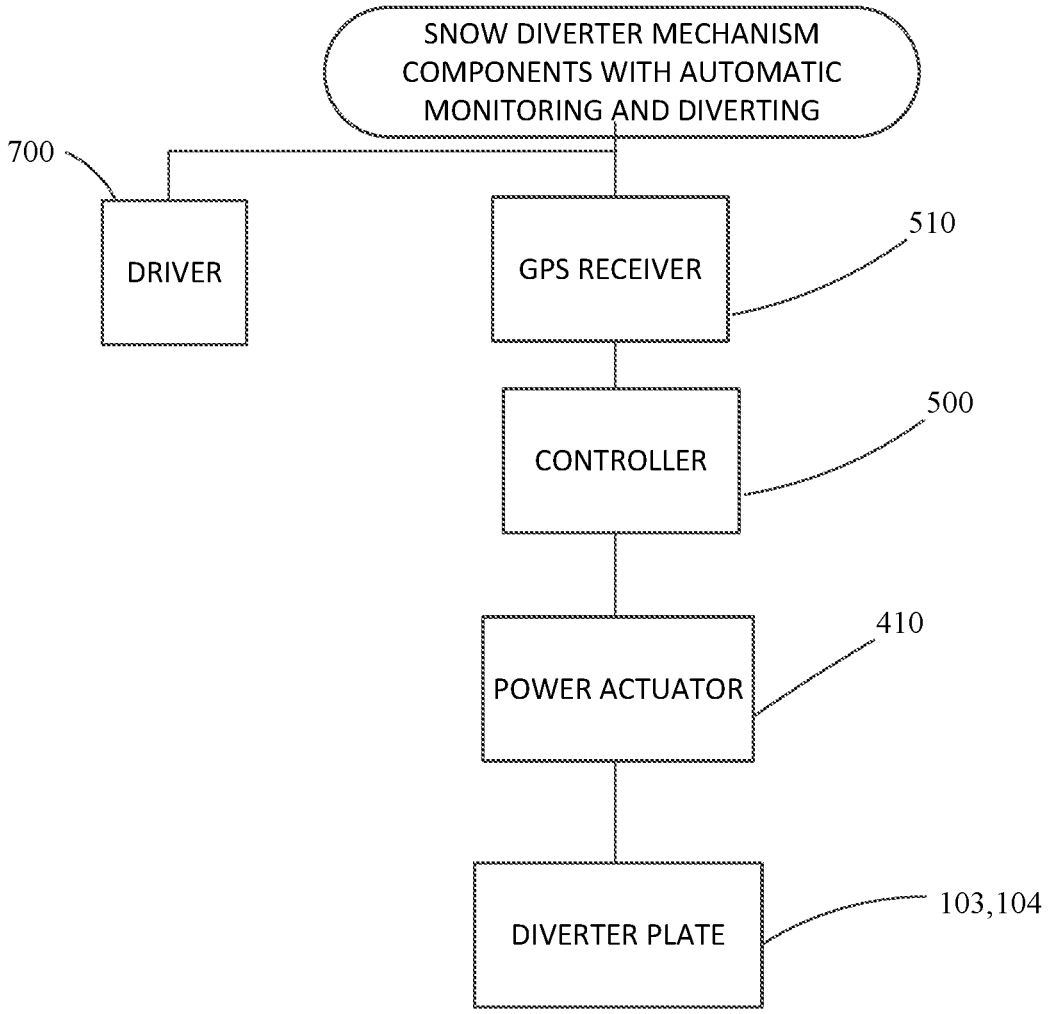
FIG. 13 is a diagram of the components of an automatic configuration (which eliminates the driver controlling the snow diverter mechanism).

FIG. 13 is a diagram of the components of an automatic configuration (which eliminates the driver 700) of the snow diverter mechanism which continuously receives GPS signals on a GPS receiver 510 which then communicates them to the controller 500. The controller 500 continually tests the distance to, at least, the nearest pre-recorded object(s) start/stop locations. When a start location is within a predefined distance from the plow blade, the controller automatically activates and deactivates the power actuator device 410 to change the diverter plate 104 between the diverting and non-diverting positions. The drivers' 700 attention is not needed in the automatic plowing operation.

Figure 14:
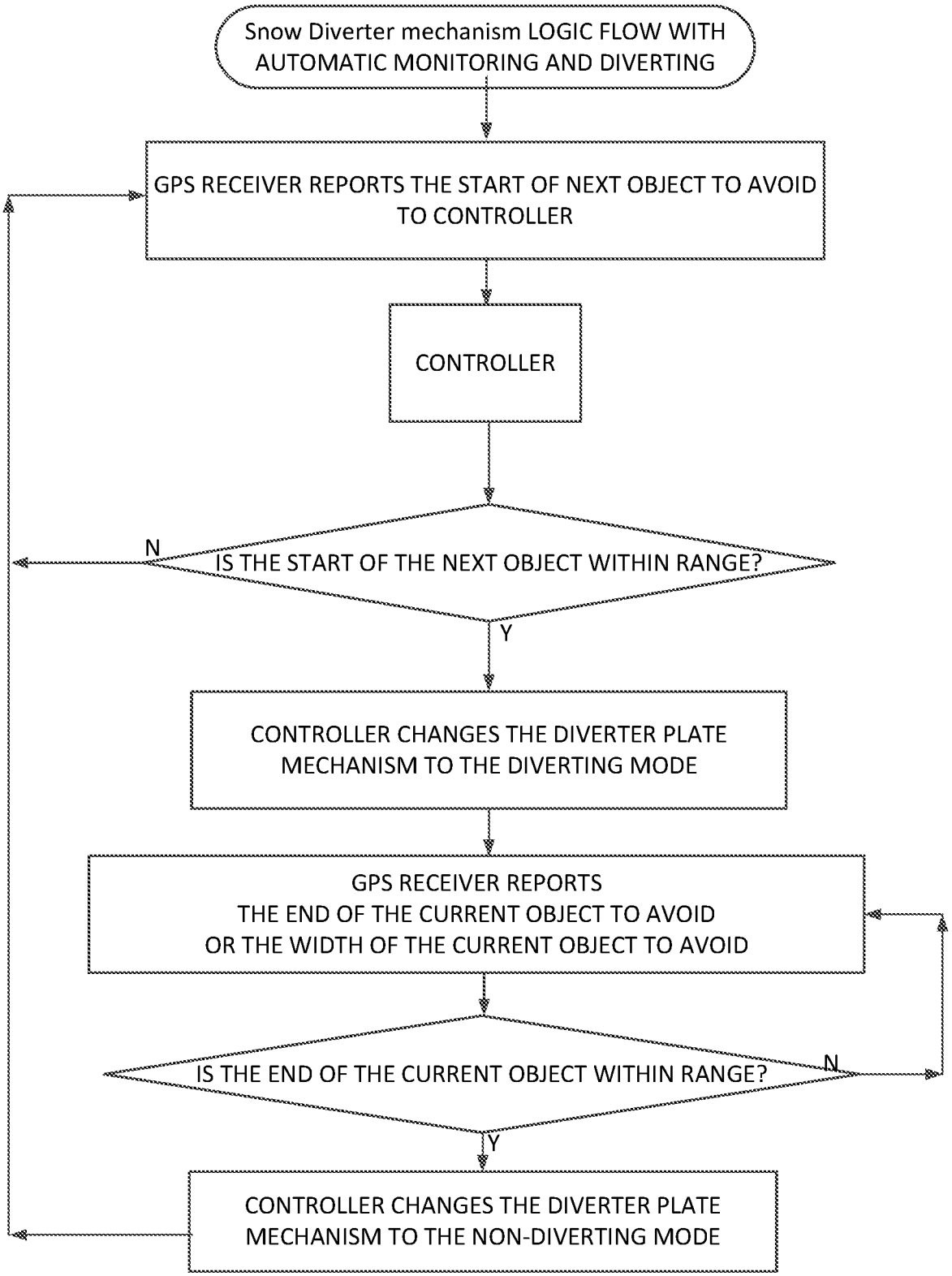
FIG. 14 is a flow chart of the automatic configuration (which eliminates the driver control of the snow diverter mechanism).

FIG. 14 is a flow chart of the operation of the automatic configuration (which eliminates the driver) of the snow diverter mechanism. The GPS receiver continually monitors for the start of each object to avoid and reports to the controller. When an object is within a predetermined threshold distance of the snow plow blade, the snow diverter mechanism is changed to the diverting mode which causes the plowed snow to be pushed in front of the snow plow blade instead of being thrown over the edge of the roadway as in the non-diverting mode. When the object is passed, the snow diverter mechanism is changed back to the non-diverting mode and the plowed snow is once again thrown over the side of the roadway being plowed.

Figure 15:
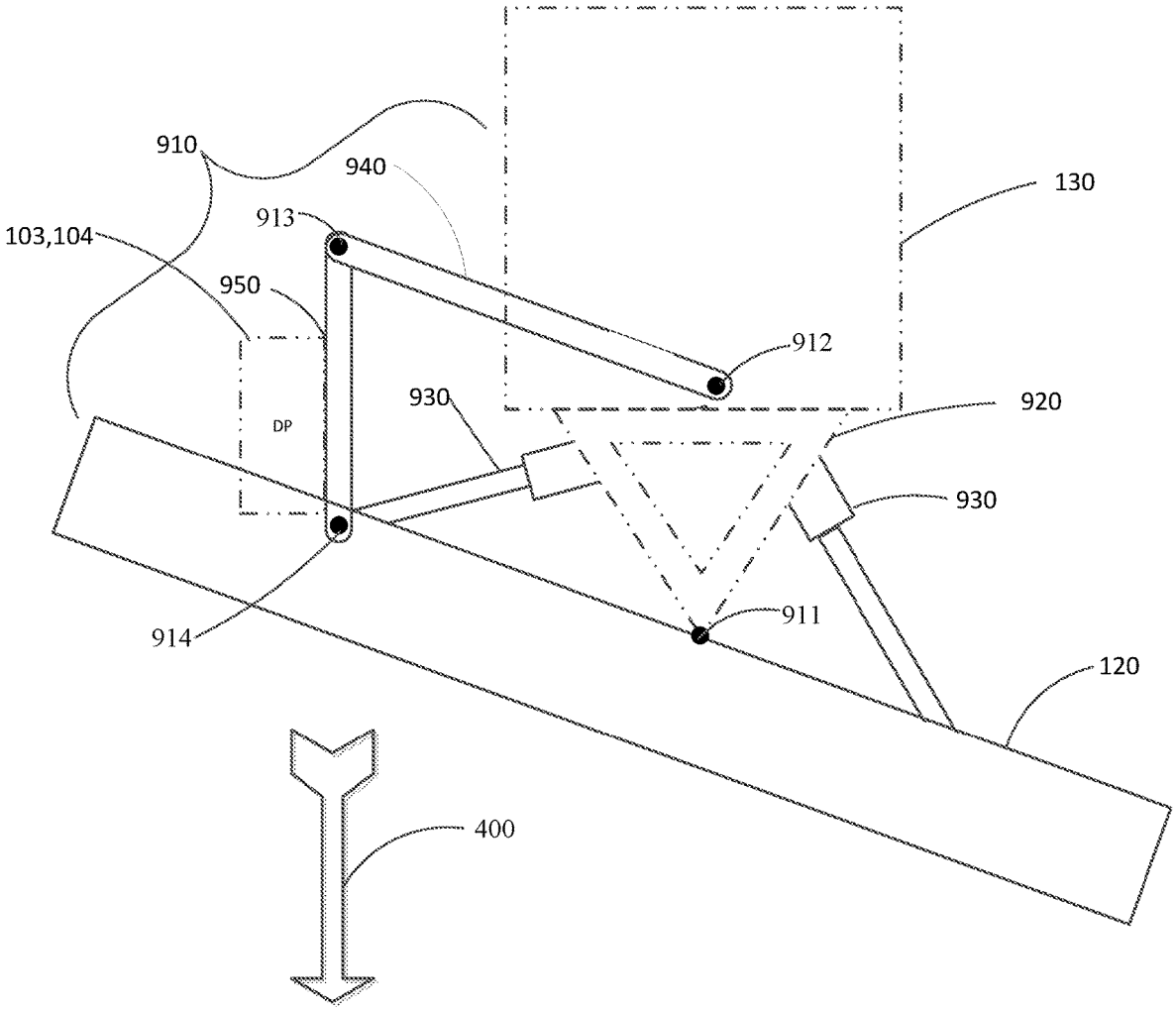
FIG. 15 is a sketch of the snow diverter positioning device which causes the diverter plate device to always be parallel to the direction of travel of the snow plow vehicle regardless of the angle of attach of the snow plow blade.

FIG. 15 is a sketch of the snow diverter positioning device 910 which causes the diverter plate 103, 104, shown in phantom lines and labeled with "DP", to always be approximately parallel to the direction of travel 400 of the snow plow vehicle 130 regardless of the angle of attach of the snow plow blade. The A-frame 920, which is integral to the snow plow vehicle 130, is pivotally connected to the snow plow blade 120 at the first pivot point 911. The proximal end of the first lever 940 is pivotally connected to the snow plow vehicle 130 at the second pivot point 912. The proximal end of the second lever 950 is pivotally connected to the distal end of the first lever 940 at the third pivot point 913. The distal end of the second lever 950 is pivotally connected to the snow plow blade 120 at the fourth pivot point 914. The four pivot points function as the four corners in a flexible parallelogram. Since the A-frame is always parallel to the direction of travel of the snow plow vehicle, the second lever 950 will always be parallel to the direction of travel 400. Since diverter plate device 104 is connected to the second lever, the diverter plate device 104 will also always be parallel to the direction of travel 400.

Figure 16:
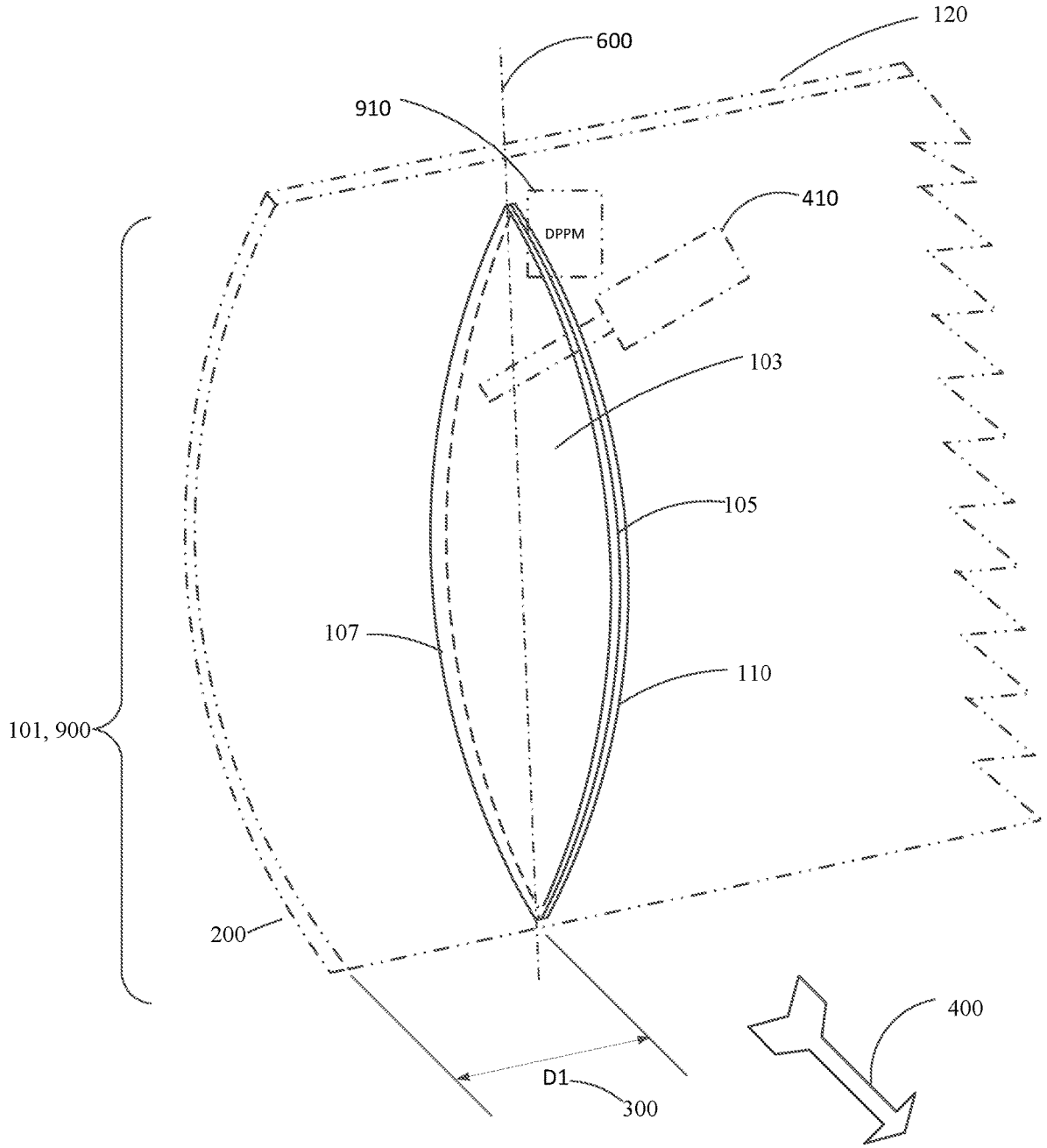
FIG. 16 is a perspective sketch of the first embodiment of the snow diverter mechanism showing the snow diverter plate positioning mechanism.

FIG. 16 is a perspective sketch of the first embodiment 101 of the snow diverter mechanism 900 with a snow diverter plate positioning mechanism 910 (shown in phantom lines and labeled with "DPPM"). The snow diverter mechanism 101 is in the diverting position on its pivot axis 600 on the plow blade 120 (shown in phantom lines as a cut-a-way view) which is moving in a forward direction of travel 400. The diverter plate 103 has a tapered 110 leading edge 105 and a trailing edge 107. The plate is made to change positions by the power actuator device 410. The pivot axis is located a predetermined distance "D1" 300 from the first side edge of the plow blade.

Figure 17:
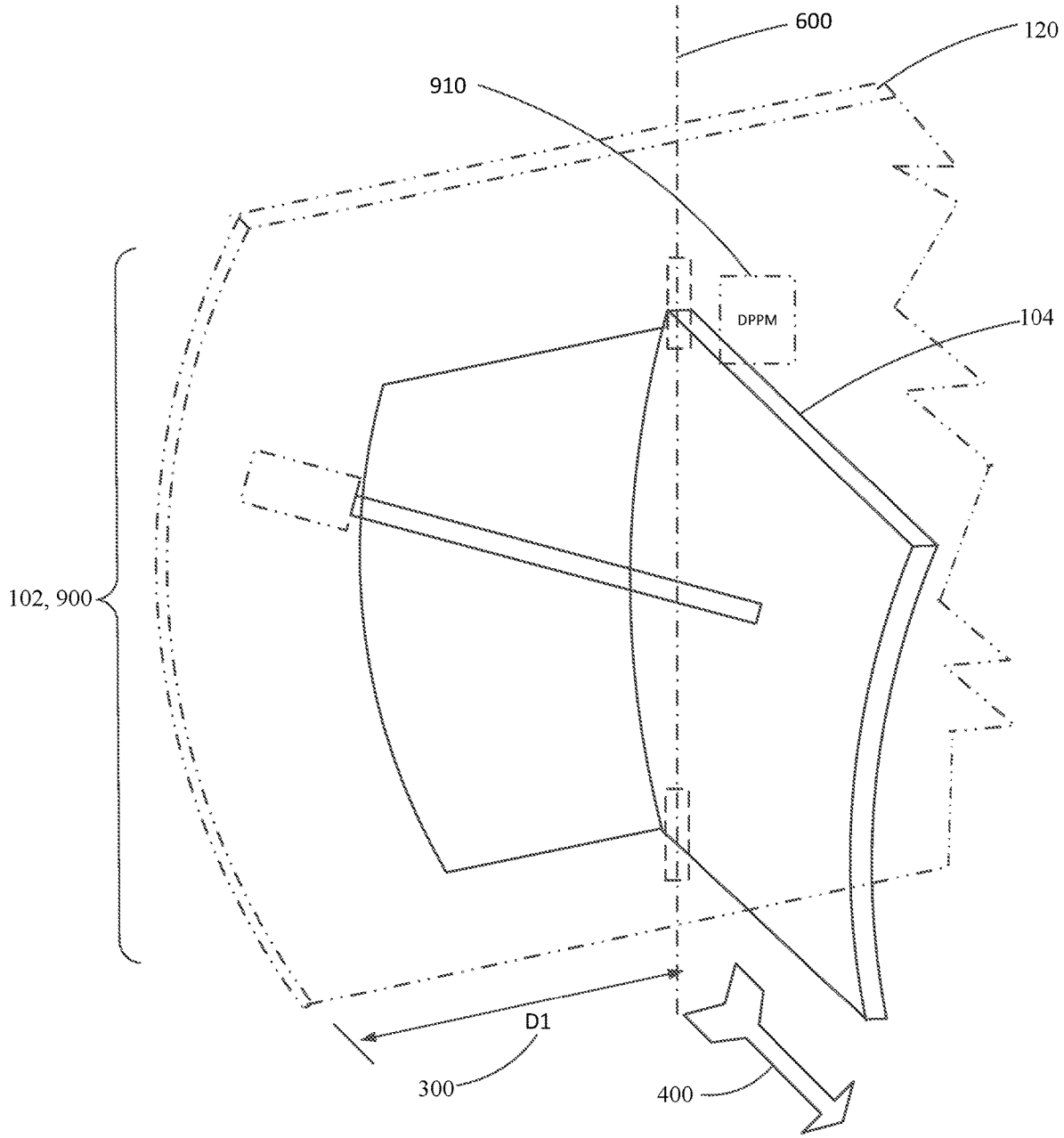
FIG. 17 is a perspective sketch of the second embodiment of the snow diverter mechanism showing the snow diverter plate positioning mechanism.

FIG. 17 is a perspective sketch of the second embodiment 102 of the snow diverter mechanism 900 with a snow diverter positioning mechanism 910 (shown in phantom lines and labeled with "DPPM"). The snow diverter mechanism is in the diverting position on its pivot axis 600 on the plow blade 120 (shown in phantom lines as a cut-a-way view) which is moving in a forward direction of travel 400. The plate is made to change positions by the power actuator device 410. The pivot axis is located a predetermined distance "D1" 300 from the first side edge of the plow blade.

CONCLUSION

When the snow diverter mechanism is installed on the inside curve of a snow plow blade at a pre-defined distance from the side edge of the plow blade, the snow plow driver is able to manually divert the plowed snow away from objects to be avoided, such as driveways, fire hydrants, mail boxes and cross streets without the danger of the snow diverter mechanism snagging of a curb or other obstacle. The addition of an automatic object detection system, see U.S. Pat. No. 10,612,202, automates the snow diversion process thereby reducing the skills required of the snow plow driver.

A second snow diverter device installed near the opposite end of the snow plow blade with both snow diverter mechanism(s) are able to work independently or together as desired. This allows the snow plow vehicle to be used in a snow throwing configuration or in a snow pushing configuration on either side of the roadway and in either direction. The present invention, with one or two diverter devices, solves the long standing problem in snowy areas of having to clear a roadway without throwing the plowed snow on objects such as driveways, fire hydrants, mail boxes or cross streets.

An optional snow diverter positioning mechanism is included to insure that the snow diverter plate is always parallel to the direction of travel regardless of the angle of attack of the plow blade.

Although the present invention has been described in considerable detail with reference to two embodiments thereof, other embodiments would be readily apparent to those of ordinary skill in the art. Therefore, the spirit and scope of the appended claims should not be limited to the description of the preferred embodiments contained herein.

I claim:

1. A snow diverter mechanism for preventing plowed snow from being thrown on predefined objects at predefined locations, the snow diverter mechanism designed and constructed to be mounted on the inside curve of a snow plow blade at a first predetermined distance from the edge of the snow plow blade, the snow plow blade pivotally mounted on a snow plow vehicle, the snow plow blade having an approximately straight bottom edge, the bottom edge for scraping the surface being plowed, the snow plow blade having a first curved side edge, the snow plow blade having a second curved side edge, the snow diverter mechanism having a diverting mode, the snow diverter mechanism having a non-diverting mode, the snow diverter mechanism comprising:

a diverter plate, the diverter plate having a non-diverting position when the snow diverter mechanism is in the non-diverting mode, and the diverter plate having a diverting position when the snow diverter mechanism is in the snow diverting mode, and whereby the diverting position of the diverter plate blocks the flow of plowed snow along the width of the snow plow blade thereby causing the plowed snow to be pushed in front of the snow plow blade, and whereby the non-diverting position of the diverter plate allows the flow of plowed snow along the width of the snow plow blade thereby causing the plowed snow to be thrown off of the curved side edge of the snow plow blade, and wherein mounting of the diverter plate at the first predefined distance of the from the first curved side edge of the snow plow blade making it impossible for the diverter plate to snag on a curb or other obstacle, and a power actuator, the power actuator for changing the snow diverter mechanism between the diverter mode and the non-diverter mode, the power actuator having a proximal end and a distal end, the distal end of the power actuator pivotally connected to the diverter plate, the proximal end of the power actuator pivotally connected to the snow plow blade, and a controller for causing the power actuator to change the snow diverter mechanism between the diverting mode and the non-diverting mode, the controller operationally connected to the power actuator, and a diverter plate positioning mechanism, the diverter plate positioning mechanism for positioning the diverter plate to be approximately parallel to the direction of travel of the snow plow vehicle regardless of the attack angle of the snow plow blade relative to the snow plow vehicle, wherein the snow plow blade is pivotally connected to the snow plow vehicle at a first pivot point, the diverter plate positioning mechanism comprising:

a first lever, the first lever having a proximal end and a distal end, the proximal end of the first lever pivotally connected to the snow plow vehicle at a second pivot point, and a second lever, the second lever having a proximal end and a distal end, the proximal end of the second lever pivotally connected to the distal end of the first lever at a third pivot point, the distal end of the second lever pivotally connected to the snow plow blade at a fourth pivot point, whereby the interaction of the first and second levers, with the turning of the snow plow blade relative to the snow plow vehicle, will cause the four pivot points to function as the four corners in a flexible parallelogram thereby causing the second lever to always be approximately parallel to the direction of travel of the snow plow vehicle, and wherein the diverter plate is connected to the second lever thereby causing the diverter plate to always be approximately parallel to the direction of travel of the snow plow vehicle thereby preventing the diverter plate from ever snagging on a curb or other obstacle while the snow plow vehicle is plowing snow with the snow diverter mechanism in the diverting mode, and wherein the snow diverter mechanism is able to avoid throwing plowed snow on the predefined objects, such as driveways, fire hydrants, mailboxes and cross streets by pushing the plowed snow past said predefined objects when the snow diverter mechanism is in the diverting mode and the snow diverter mechanism is able to throw plowed snow off the side edge of the snow plow blade after the snow plow vehicle has passed by the predefined objects and the snow diverter mechanism is changed back to the non-diverting mode.

2. The snow diverter mechanism of claim 1 further comprises a global positioning system for determining the location of the snow plow blade relative to the predetermined locations of the predefined objects, and wherein the controller is designed and constructed to determine the distance between the location of the snow plow blade and the location of each of the predefined objects, and wherein the controller is designed and configured to change the snow diverter mechanism to the diverting mode when the distance between the snow plow blade and any predefined object is less than a second predefined distance.

3. The snow diverter mechanism of claim 1, wherein the power actuator is selected from the group comprising: a hydraulic actuator, a pneumatic actuator and an electrical actuator.

4. The snow diverter mechanism of claim 1, wherein the controller is operated by an entity selected from the group consisting of a human operator and a computer.

5. The snow diverter mechanism of claim 1, wherein the snow plow vehicle is controlled by an entity selected from the group consisting of a human operator and a computer.

6. The snow diverter mechanism of claim 1, wherein the diverter plate is a generally flat oval shaped plane with a first curved side edge having a concave curve of approximately the same radius as the inside convex curve of the snow plow blade, the first curved side edge designed and constructed to approximately contact the inside convex curve of the snow plow blade when the diverter plate is in the diverting position thereby impeding the flow of snow along the width of the snow plow blade thereby causing the plowed snow to be pushed in front of the snow plow blade when plowing snow with the snow diverter mechanism in the diverting mode, and wherein the diverter plate is rotated to a position approximately parallel to the flow of snow along the width of the snow plow blade thereby causing minimal resistance to the flow of plowed snow along the width of the snow plow blade when the snow diverter mechanism is changed to the non-diverting mode thereby causing the plowed snow to be thrown off the first curved side edge of the snow plow blade when plowing snow with the snow diverter mechanism in the non-diverting mode.

7. The snow diverter mechanism of claim 6, wherein the leading edge of the diverter plate has a taper, the taper designed and constructed to minimize the resistance to the flow of snow along the width of the snow plow blade when the snow diverter mechanism is in the non-diverter mode.

8. The snow diverter mechanism of claim 1, wherein the diverter plate is a generally flat rectangular shaped plane with a first side edge having a concave curve of approximately the same radius as the inside convex curve of the snow plow blade, the first side edge designed and constructed to fill an opening in the snow plow blade without impeding the flow of plowed snow along the width of the snow plow blade when plowing snow with the snow diverter mechanism in the non-diverting mode and wherein the diverter plate is pivoted forward by the power actuator to the diverting position when the snow diverter mechanism changed to the diverting mode thereby pushing the plowed snow in front of the plow blade to avoid the predefined objects.

9. The snow diverter mechanism of claim 1, wherein a second snow diverter mechanism is mounted at the first predefined distance from the second curved side edge of the snow plow blade, and wherein the first snow diverter mechanism and the second snow diverter mechanism is pivotally connected to the snow plow blade.

10. The snow diverter mechanism of claim 9, wherein first and second snow diverter mechanisms are designed, constructed and installed to pivot independently from each other.

11. The snow diverter mechanism of claim 9, wherein first and second snow diverter mechanisms are designed, constructed and synchronized to cause the first and second snow diverter mechanisms to pivot together with each other.

* * * * *